US007155772B2

(12) United States Patent
Lee

(10) Patent No.: US 7,155,772 B2
(45) Date of Patent: Jan. 2, 2007

(54) FIXING DEVICE FOR ATTACHING/DETACHING DUST RECEPTACLE OF CYCLONE-TYPE VACUUM CLEANER AND VACUUM CLEANER HAVING THE SAME

(75) Inventor: Yong-hee Lee, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 662 days.

(21) Appl. No.: 10/660,716

(22) Filed: Sep. 12, 2003

(65) Prior Publication Data

US 2004/0123416 A1 Jul. 1, 2004

(30) Foreign Application Priority Data

Dec. 31, 2002 (KR) ..... 10-2002-0088130

(51) Int. Cl.
*A47L 9/16* (2006.01)

(52) U.S. Cl. ..... 15/353; 15/352; 55/429; 55/DIG. 3

(58) Field of Classification Search ..... None
See application file for complete search history.

(56) References Cited

U.S. PATENT DOCUMENTS 6,735,816 B1 * 5/2004 Oh et al. ..... 15/353
6,782,584 B1 * 8/2004 Choi ..... 15/352

FOREIGN PATENT DOCUMENTS

| | | | |
|---|---|---|---|
| DE | 10056935 | A1 | 2/2002 |
| GB | 2370979 | A | 7/2002 |
| GB | 2376175 | A | 12/2002 |
| GB | 2 385 515 | A | 8/2003 |
| WO | WO 01/35809 | A1 | 5/2001 |

OTHER PUBLICATIONS

Russian Office Action dated Sep. 6, 2004 with Translation.
British Patent Office, Combined Search and Examination Report Issued Apr. 27, 2004 with respect to British Application No. 0325411.7.
German Patent Office, Office Action dated May 11, 2005 with respect to German Application No. 10351009.5-15 filed Oct. 13, 2003.

* cited by examiner

*Primary Examiner*—David Redding
(74) *Attorney, Agent, or Firm*—Blank Rome LLP

(57) ABSTRACT

A fixing device for attaching and detaching a dust receptacle to and from a cyclone unit, which comprises a cyclone body and the dust receptacle and mounted in a mounting portion of a cleaner body. The fixing device comprises a dust receptacle comprising a sliding groove formed with a predetermined depth and height extended backward from a center of a bottom side of the dust receptacle that is opposite to a bottom side of the mounting portion. A guide member is disposed in the sliding groove for guiding attachment and detachment of the dust receptacle. An operation lever with a cam part having a cam projection for insertion into the cam guider, is rotated and counter-rotated to thereby move the guide member upward and downward at a height according to an eccentricity of the cam part.

4 Claims, 4 Drawing Sheets

FIXING DEVICE FOR ATTACHING/DETACHING DUST RECEPTACLE OF CYCLONE-TYPE VACUUM CLEANER AND VACUUM CLEANER HAVING THE SAME

FIELD OF THE INVENTION

The present invention generally relates to a vacuum cleaner, and more specifically to a fixing device for attaching and detaching a dust receptacle of a cyclone type vacuum cleaner having a cyclone unit for separating contaminants from a contaminant-laden air by a centrifugal force that is formed from a revolving stream of a drawn air.

BACKGROUND OF THE INVENTION

As shown FIG. 1, a conventional cyclone type vacuum cleaner comprises a cleaner body 10 and a cyclone unit 20 removably mounted in a mounting portion 11 of the cleaner body 10.

The cleaner body 10 has a vacuum generating device (not shown) therein, and a suction brush 12 at a lower portion of the cleaner body 10.

The cyclone unit 20 has a cyclone body 30, and a dust receptacle 40 which is removably mounted at the cyclone body 30.

The cyclone body 30 has an inflow passage 31 on an upper side which by design is in fluid communication with the suction brush 12. Accordingly, the contaminants, drawn in from a surface to be cleaned by action of the suction brush 12, flow into the cyclone body 30 via the inflow passage 31. The inflow passage 31 is formed in such a manner that the air is drawn in to the cyclone body 30 through the inflow passage 31 in a tangential direction. Accordingly, the air drawn in through the inflow passage 31 is formed into a whirling current rotating along the inner wall of the cyclone body 30.

The cyclone body 30 also has an outflow passage 32 formed on the center of the upper side of the cyclone body 30, which by design is fluidly communicated with the vacuum generating device 30. When the contaminants are removed from the air, the clean air is discharged from the cleaner body 10 through the outflow passage 32 and the vacuum generating device. The contaminants removed from the air in the cyclone body 30 are collected in the dust receptacle 40.

A pair of tubes 13, 14 is positioned such that one end of each tube faces forward, with the other end of the first tube 13 being connected to the vacuum generating device and the other end of the second tube 14 connected to the suction brush 12. The inflow passage 31 and the outflow passage 32 face backward in parallel corresponding to the first and second tubes 13, 14. Accordingly, simply by inserting the cyclone body 30 horizontally in the mounting portion 11, the inflow passage 31 and the outflow passage 32 are connected with the pair of the tubes 13, 14 respectively.

A locking handle 33 is pivotably disposed on the outside of the rear portion of the cyclone body 30. A handle coupling portion 15 is formed on the cleaner body 10 corresponding to the locking handle 30. Accordingly, the cyclone body 30 is securely mounted in the cleaner body 10 by inserting the locking handle 33 through the handle coupling portion 13, and turning the locking handle 33 at 90°.

However, an operator of the conventional cyclone type vacuum cleaner as described above experiences an inconvenience when emptying the contaminants in the dust receptacle 40, because the operator has to first separate the whole cyclone unit 20 from the mounting portion 11 of the cleaner body 10, and then separate the dust receptacle 40 from the cyclone body 30.

In other words, the conventional cyclone type vacuum cleaner has the structure which does not allow separating of the dust receptacle 40 alone from the mounting portion 11 of the cleaner body 10. As a result, the removing operation of dust collected in the dust receptacle 40 requires complicated steps of releasing a fixing device for the cyclone body 30 to the cleaner body 10, separating the whole cyclone unit 20 from the cleaner body 10, separating the dust receptacle 40 from the cyclone body 30, removing the contaminants in the dust receptacle 40, and mounting the cyclone unit 20 to the cleaner body 10 through the reverse steps.

SUMMARY OF THE INVENTION

The present invention has been made to rectify the above problem, and an object of the present invention is to provide a fixing device for attaching and detaching a dust receptacle of the cyclone type vacuum cleaner, which enables only the dust receptacle to be attached and detached with a cyclone body fixed to the cleaner body so that a user can empty contaminants collected in the dust receptacle with convenience.

Another object of the present invention is to provide a cyclone type vacuum cleaner having the fixing device with a greatly improved convenience.

To accomplish the former object of the present invention, a fixing device is provided for attaching and detaching only a dust receptacle to and from a cyclone unit. The cyclone unit is mounted in a mounting portion, and comprises a cyclone body and the dust receptacle. The fixing devices comprises the dust receptacle comprising a sliding groove which is formed with a predetermined depth and height extended backward from approximately a center of a bottom side of the dust receptacle, with the bottom side opposite to a bottom side of the mounting portion; a guide member disposed in the sliding groove for guiding attachment and detachment of the dust receptacle, having a cam guider comprising a first and a second receiving recesses with different height respectively; and an operation lever comprising a cam part having a cam projection for insertion to the cam guider, a rotary shaft extended from the cam part, and a manipulating part formed at one end of the rotary shaft, the operation lever disposed in the cleaner body to protrude outside of the cleaner body for being rotation and counter-rotation to thereby move the guide member upward and downward at a height according to the eccentricity of the cam part.

In the fixing device according to the present invention, as the operation lever is rotated and counter-rotated, the dust receptacle is moved upward and downward with respect to the cyclone body. As s result, the dust receptacle is separated from the mounting portion of the cleaner body, independently from the cyclone body so that the collected contaminants are removed.

To accomplish the latter object of the present invention, a cyclone type vacuum cleaner is provided comprising a cleaner body having a vacuum generating device, and a suction bush at a lower portion of the cleaner body. A cyclone body is disposed in a mounting portion of the cleaner body for separating contaminants in an air drawn in through an inflow passage which is communicating with the suction brush and discharging the clean air through an outflow passage which is communicating with the vacuum generating device. A dust receptacle is detachably connected to the cyclone body for collecting the contaminants which are separated in the cyclone body, and a fixing device for separately attaching and detaching the dust receptacle to and from the mounting portion, independently from the cyclone body. The fixing device further comprises a dust receptacle comprising a sliding groove, the sliding groove formed with a predetermined depth and height extended backward from approximately a center of a bottom side of the dust receptacle that is opposite to a bottom side of the mounting portion; a guide member disposed in the sliding groove for guiding attachment and detachment of the dust receptacle, having a cam guider comprising a first and a second receiving recesses with different height respectively, and an operation lever comprising a cam part having a cam projection for insertion to the cam guider. A rotary shaft is extended from the cam part, and a manipulating part is formed at one end of the rotary shaft. The operation lever is disposed in the cleaner body to protrude outside of the cleaner body for rotation and counter-rotation and thereby move the guide member upward and downward at a height according to the eccentricity of the cam part.

The cyclone body is mounted in the mounting portion in such a manner that a locking handle formed on a rear portion of the cyclone body is inserted in and fixed to a handle coupling portion formed on inner wall of the mounting portion of the cleaner body.

A handle is formed at a front portion of the dust receptacle for gripping the dust receptacle.

BRIEF DESCRIPTION OF THE DRAWINGS

The aforementioned objects and the features of the present invention will be more apparent by describing the preferred embodiment of the present invention by referring to the accompanying drawings, in which.

DETAILED DESCRIPTION OF THE PREFERRED EMBODIMENT

Hereinafter, the present invention is described in great detail with reference to the accompanying drawings.

Figure 1:
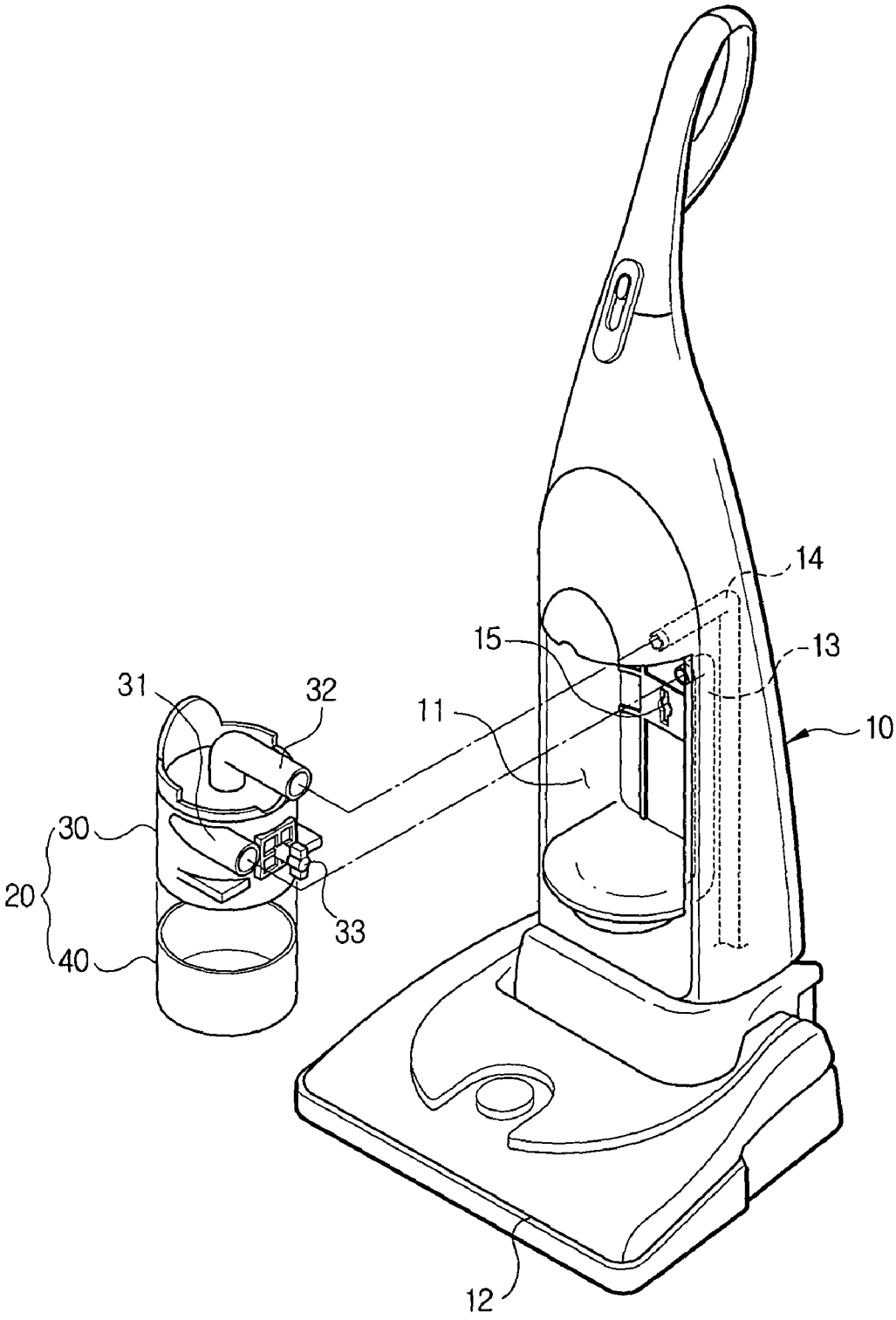
FIG. 1 (PRIOR ART)
FIG. 1 is a perspective view showing a cyclone unit detached from a conventional cyclone type vacuum cleaner.
Figure 2:
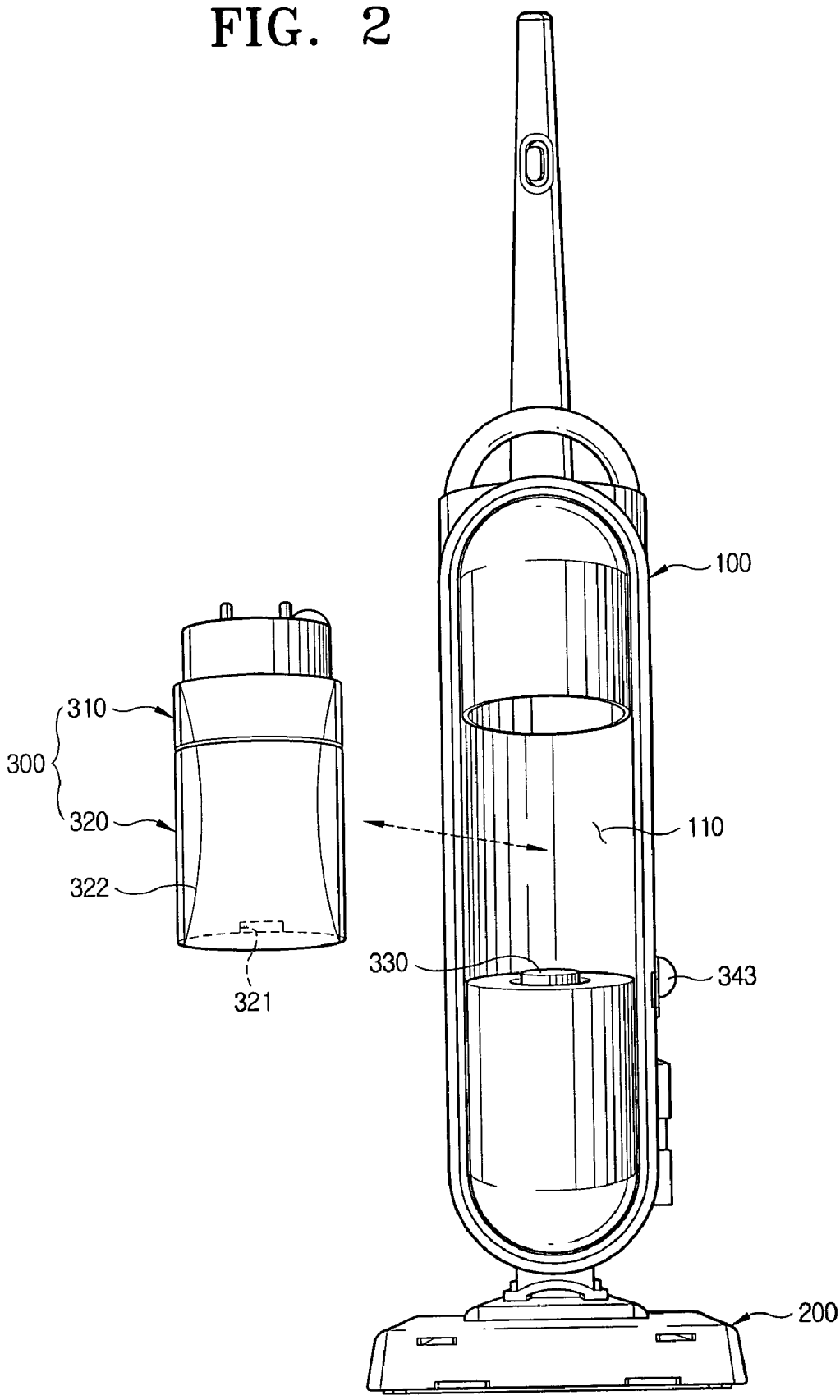
FIG. 2 is a perspective view showing a cyclone unit detached from a cyclone type vacuum cleaner having a fixing device according to the present invention.

Referring to FIG. 2, a reference numeral 100 indicates a cleaner body, 200 indicates a suction brush, and 300 indicates a cyclone unit.

The cleaner body 100 is provided with a mounting portion 110 wherein the cyclone unit 300 is mounted, and also provided with a vacuum generating device (not shown) therein. The suction brush 200 is disposed at a lower portion of the cleaner body 100.

Figure 3:
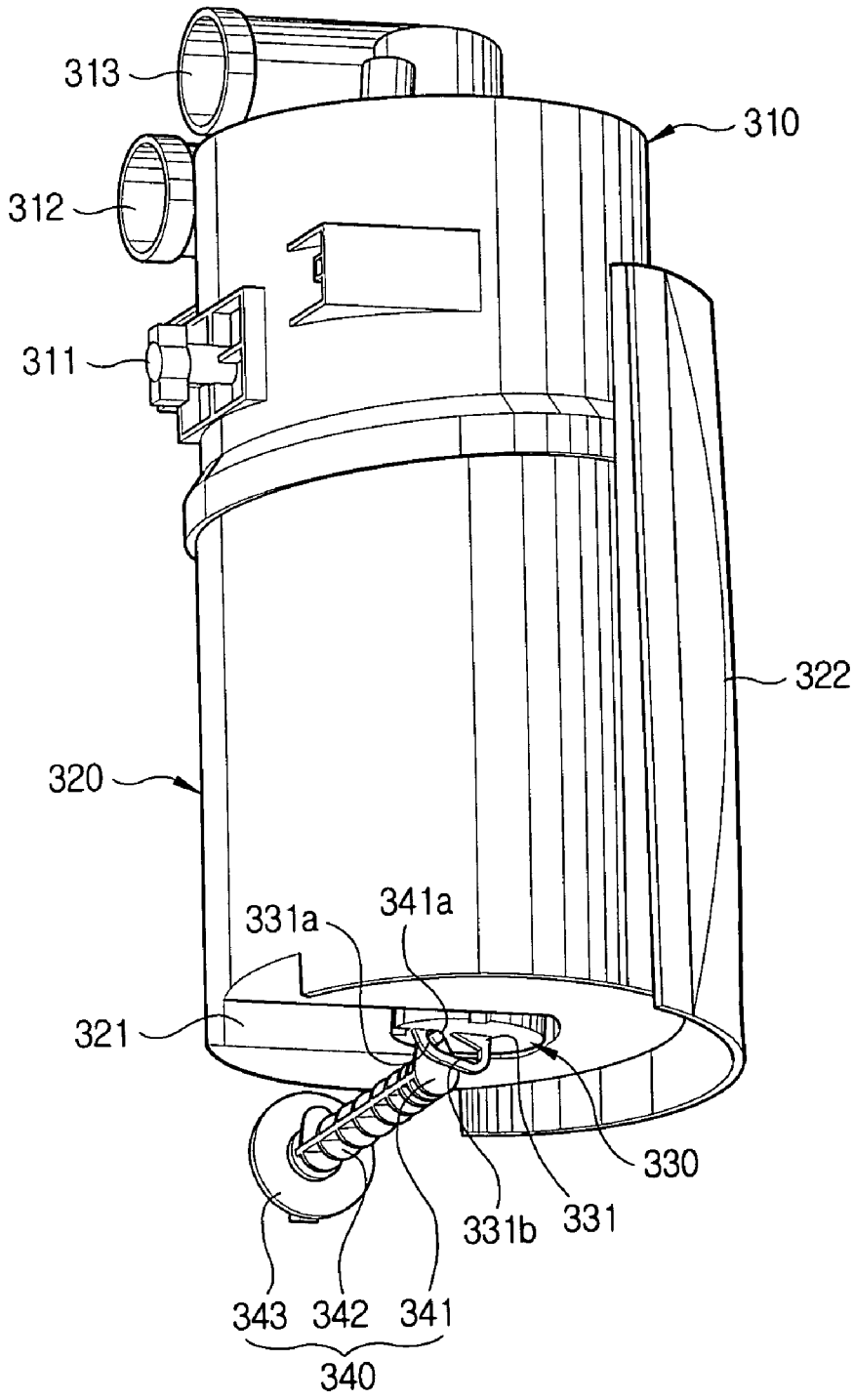
FIG. 3 is a bottom view showing the fixing device according to the present invention.

The cyclone unit 300 comprises a cyclone body 310 and a dust receptacle 320. A locking handle 311 disposed at a rear portion of the cyclone body 310, as shown in FIG. 3, is fixed to a handle coupling portion (not shown) disposed at an inner wall of the mounting portion 110 of the cleaner body 110 to thereby securely mount the cyclone body 310 in the mounting portion 110. The dust receptacle 320 is removably attached at a bottom side of the cyclone body 310.

On an upper side of the cyclone body 310 is formed an inflow passage 312 fluidly communicating with the suction brush 200. Accordingly, contaminants on a surface to be cleaned are drawn in through the suction brush 200 and into the cyclone body 310 via the inflow passage 312. The inflow passage 312 is formed in such a manner that the air is drawn in to the cyclone body 310 in a tangential direction. Thereby the air drawn in via the inflow passage 312 is formed into a whirling current rotating along an inner sidewall of the cyclone body 310.

On a center of the upper side of the cyclone body 310 is formed an outflow passage 313 fluidly communicating with the vacuum generating device (not shown). When the contaminants are removed from the air in the cyclone body 310, the air is discharged to the outside of the cleaner body 100 via the outflow passage 313 and the vacuum generating device. The contaminants removed from the air in the cyclone body 310 are collected in the dust receptacle 320.

When the dust receptacle 320 is full with the contaminants, the user empties the collected contaminants by detaching the dust receptacle 320 from the cleaner body 100. At this time, according to the present embodiment, the dust receptacle 100 is separately attached and detached from the mounting portion 110 of the cleaner body 100, independently from the cyclone body 310.

The fixing device for separately attaching and detaching the dust receptacle 320 according to the present embodiment, as shown in FIGS. 2 through 4, comprises the dust receptacle 320, a guide member 330, and an operation lever 340.

A bottom side of the dust receptacle 320 is provided with a sliding groove 321 which is extending from about the center toward the rear portion of the dust receptacle 320 in a predetermined depth and width. On a front side of the dust receptacle 320 a handle 322 is provided for the grip of the user in handling the dust receptacle 320.

The guide member 330 is disposed in the sliding groove 321, for guiding the dust receptacle 320 for attachment and detachment. On a bottom side of the guide member 330 provided a cam guider 331 is provided having a first and a second receiving recesses 331*a*, 331*b*. The height of the first and the second receiving recesses are different from each other.

The operation lever 340 comprises a cam part 341, a rotary shaft 342 extended from the cam part 342, and a manipulating part 343 formed at one end of the rotary shaft 342. The operation lever 340 is disposed in the cleaner body 100 in such a manner that the manipulating part 343 is exposed and protruded to the outside of the cleaner body so that the operation lever 340 can rotate and counter-rotate. The cam part 341 comprises a cam projection 341*a* which is inserted to the cam guider 331.

By way of an example, as the operation lever 340 is rotated and counter-rotated by the user at 90°, the guide member 330 is moved upward and downward in proportion to the eccentricity of the cam part 341.

By the vertical movement of the guide member 330, the dust receptacle 320 is also moved upward and downward with respect to the cyclone body 310, and accordingly, the dust receptacle 320 is separately detached, i.e., independently from the cyclone body 310. The operation of attaching and detaching the dust receptacle 320 is described below in reference to FIGS. 3, 4A and 4B.

Figure 4A:
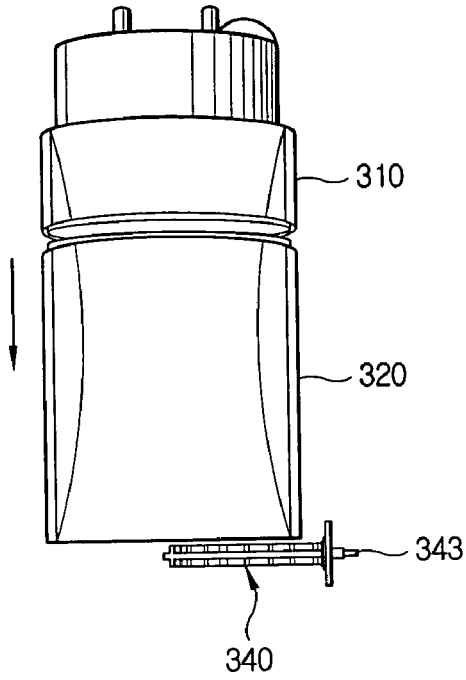
FIGS. 4A and 4B are front views showing the cyclone unit for illustrating an operation of the fixing device according to the present invention.
Figure 4B:
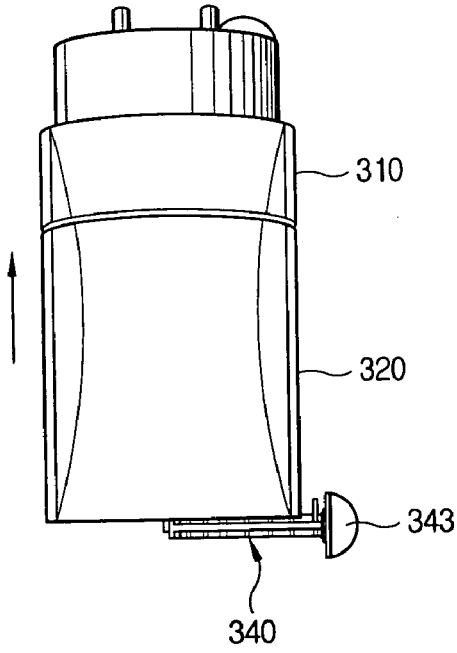

FIG. 4A illustrates the operation lever 340 counter-rotated at 90°, causing the cam projection 341*a* of the cam part 341 to be positioned in the second receiving recess 331*b* of the cam guider 331 of the guide member 330. Accordingly, the guide member 330 is descended at a predetermined height. Through this process, the dust receptacle 320, having the sliding groove 321 to which the guide member 330 is slidably connected, is also descended to thereby be separated from the cyclone body 310 by a predetermined distance. In such a situation, only the dust receptacle 320 is separated out of the mounting portion 110 of the cleaner body 100 by holding and pulling forward the handle 322 of the dust receptacle 320.

In order to attach the dust receptacle 320 to the cyclone body 310 after removing the contaminants in the dust receptacle 320, first, the dust receptacle 320 is placed as shown in FIG. 4A, and the operation lever 340 is rotated, by way of example, at 90°. Accordingly, as the cam projection 341*a* of the cam part 341 of the operation lever 340 is moved from the second receiving recess 331*b* to the first receiving recess 331*a* of the cam guider 331 of the guide member 330, the guide member 330 is lifted upward at a predetermined height. As a result, the dust receptacle 320 is also lifted upward to thereby attach to the cyclone body 310 (see FIG. 4B).

As described above, through the simple operation of the fixing device according to the present embodiment, the dust receptacle 320 is easily attached to and detached from the mounting portion 110 of the cleaner body 100, independently from the cyclone body 310. Accordingly, the user can remove the contaminants collected in the dust receptacle 320 with more convenience.

According to the present embodiment, the dust receptacle 320 is separately attached to, and detached from the cyclone unit 300 mounted in the mounting portion 110 of the cleaner body 110, independently from the cyclone body 310. Therefore, when emptying the contaminants collected in the dust receptacle 320, the user can separate just the dust receptacle 320, and then re-attach to the cyclone unit 300 with convenience.

That is, the convenience in using the cyclone type vacuum cleaner is dramatically improved to thereby provide the satisfaction to the user and strengthen the competitiveness of the cyclone type vacuum cleaner.

A few preferred embodiments of the present invention have been disclosed herein and, although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims. Therefore, all embodiments that come within the spit and scope of the following claims and equivalents thereto are claimed as the invention.

What is claimed is:

1. A fixing device for attaching and detaching a dust receptacle of a cyclone type vacuum cleaner, the cyclone type vacuum cleaner comprising a cleaner body including a mounting portion, and a cyclone unit including a cyclone body and the dust receptacle, comprising:

a dust receptacle comprising a sliding groove, the sliding groove formed with a predetermined depth and height extended backward from an approximate center of a bottom side of the dust receptacle that is opposite to a bottom side of the mounting portion;

a guide member disposed in the sliding groove for guiding attachment and detachment of the dust receptacle, and comprising a cam guider having first and second receiving recesses in different heights, respectively; and an operation lever comprising a cam part having a cam projection for insertion into the cam guider, a rotary shaft extended from the cam part, and a manipulating part formed at one end of the rotary shaft, wherein the operation lever is disposed in the cleaner body to be protruded outside of the cleaner body for rotation and counter-rotation to thereby move the guide member upward and downward at a height according to an eccentricity of the cam part.

2. A cyclone type vacuum cleaner, comprising:

a cleaner body having a vacuum generating device, and a suction bush at a lower portion of the cleaner body;

a cyclone body disposed in a mounting portion of the cleaner body for separating contaminants in air drawn in through an inflow passage which is in fluid communication with the suction brush, and discharging the clean air through an outflow passage which is in fluid communication with the vacuum generating device;

a dust receptacle detachably connected to the cyclone body for collecting the contaminants which are separated in the cyclone body; and a fixing device for separately attaching and detaching the dust receptacle to and from the mounting portion, independently from the cyclone body, wherein the fixing device further comprises a dust receptacle comprising a sliding groove, the sliding groove formed with a predetermined depth and height extended backward from a center of a bottom side of the dust receptacle that is opposite to a bottom side of the mounting portion, wherein a guide member is disposed in the sliding groove for guiding attachment and detachment of the dust receptacle, and comprising a cam guider with first and second receiving recesses with different heights, respectively, and wherein an operation lever comprises, a cam part with a cam projection for insertion into the cam guider, a rotary shaft extended from the cam part, and a manipulating part formed at one end of the rotary shaft, and wherein the operation lever is disposed in the cleaner body to protrude outside of the cleaner body for rotation and counter-rotation to thereby move the guide member upward and downward at a height according to an eccentricity of the cam part.

3. The vacuum cleaner of claim 2, wherein the cyclone body is mounted in the mounting portion, and a locking handle formed on a rear portion of the cyclone body is inserted in and fixed to a handle coupling portion formed on an inner wall of the mounting portion of the cleaner body.

4. The vacuum cleaner of claim 2, wherein a handle is formed at a front portion of the dust receptacle for a user to grip while handling the dust receptacle.

* * * * *